United States Patent [19]

Rosenthal

[11] 3,947,927

[45] Apr. 6, 1976

[54] SKI TIE

[76] Inventor: Allen M. Rosenthal, 6 Northstar St., Marina Del Rey, Calif. 90291

[22] Filed: Aug. 26, 1974

[21] Appl. No.: 500,422

[52] U.S. Cl. ..... 24/81 SK; 24/16 R; 24/73 SG; 24/81 CC; 24/204; 224/45 S

[51] Int. Cl.[2] ..... A44B 21/00; B65D 63/00

[58] Field of Search ... 24/3 M, 81 SK, 73 SG, 73 A, 24/16 R, 74 A, DIG. 18, DIG. 29, 204, 81 CC, 81 AG, 73 BB; 224/45 S, 5 Z; 2/DIG. 6; 180/11.37 A

[56] References Cited

UNITED STATES PATENTS

| | | | |
|---|---|---|---|
| 3,307,872 | 3/1967 | Murcott | 24/DIG. 18 |
| 3,430,299 | 3/1969 | Copen | 24/16 R |
| 3,486,672 | 12/1969 | Esopi | 24/81 SK |
| 3,653,565 | 4/1972 | McAusland | 224/45 S |

*Primary Examiner*—Bernard A. Gelak
*Attorney, Agent, or Firm*—Nilsson, Robbins, Dalgarn & Berliner

[57] ABSTRACT

A tie useful for securing together a pair of skis and a pair of ski poles for ease of carrying them as one unit with the poles acting as a carrying handle. The tie includes an elongate, flexible tape having opposite free end segments which matingly engage adjacent portions of a central segment on the same tape side via filamentary loops and hooks. The free end segments are threadable through eyes operable on the opposite tape side, and are bent back and coupled to the central segment to form a figure eight, the loops of which separately enclose the skis and poles.

5 Claims, 5 Drawing Figures

SKI TIE

BACKGROUND AND SUMMARY OF THE INVENTION

In carrying ski equipment, particularly over the long distances from parking lot to ski lift, it is desirable to be able to tie the equipment together to form a compact bundle that can be carried in one hand by means of a handle. Conventional ties are only suitable for holding skis together, are bulky and awkward to use and, because of angular metal parts, are difficult and, indeed, dangerous to carry while skiing. The present invention provides a tie which readily assembles to securely strap any size skis and poles together, which is rapidly released, and which is easily and safely carried about when not in use. The tie comprises an elongate, flexible tape having opposite free end segments which matingly engage adjacent portions of a central segment on the same tape side via coupling surfaces formed of filamentary loops and hooks. The free end segments are threaded through respective ones of a pair of eyes operable on the opposite tape side, are bent back, cinched tightly and coupled to the central segment to form a figure eight, the loops of which separately enclose the skis and poles. A pair of ties can be used to secure the opposite ends of an assembly of a pair of skis and a pair of poles. When not in use, each tie can be simply wrapped around a ski pole and secured thereon by its own coupling surfaces, or safely carried unobtrusively in one's pocket. When the skis are stored, the ties can be used in single loop fashion to secure them together without affecting the camber of the skis.

DETAILED DESCRIPTION

Figure 1:
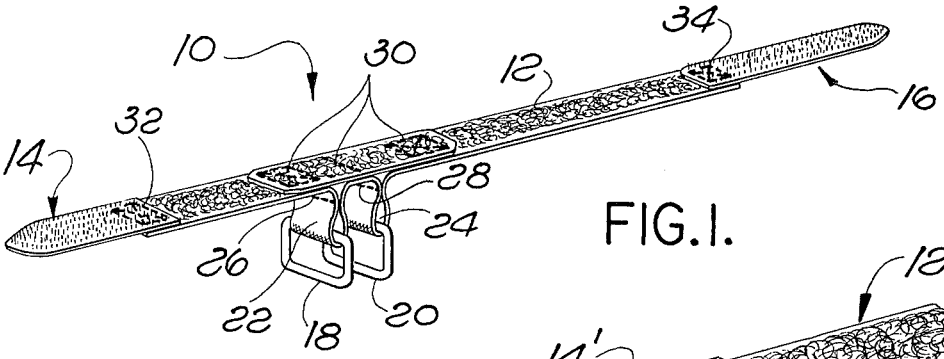
FIG. 1 is a perspective view of a tie according to the present invention.

Referring now to FIG. 1, in one embodiment, a tie 10 of the present invention is in the form of an elongate strip of flexible tape material which can be of cloth, polymer yarn, plastic or the like, and is exemplified by a nylon tape. The strip includes a central segment 12 and two free end segments 14 and 16 integrally connected thereto. The upper surface of each end segment 14 and 16 is provided with means which couple with conjugate means on the upper surface of the central segment 12. In the present illustration, the upper surface of each end segment 14 and 16 consists of a multiplicity of small filamentary hook members of curled or crinkled configuration constituting a sort of mat surface. The upper surface of the central segment 12 is formed of a mating surface consisting of a multiplicity of small loops made of filamentary material, the material being stiff enough so that the loops project outwardly from the face of the tape. The two types of surfaces display the property that when they are brought into juxtaposition, a number of the individual filamentary hook members become intertwined with the outwardly projecting loops and thereby retain the parts in coupled or fastened relation. Preferably, the interengaging surfaces are those incorporated in fastening tapes sold commercially under the trademark "VELCRO" by Velcro Corp., New York, New York. In this regard, one or more of the following VELCRO U.S. Pat. Nos. can be of interest: 2,717,437, 3,000,084, 3,009,235, 3,076,244, 3,130,111, 3,147,528, 3,154,837, 3,192,589 and 3,387,345.

The surfaces may be readily separated from one another by peeling apart, but when fastened, they strongly resist longitudinal movement. For convenience of reference, the surfaces of the end segments 14 and 16, with their individual filamentary hook members forming mats, may be referred to as male surfaces, while the surface of the central segment 12 with its multiplicity of loops of filamentary material may be referred to as a female surface.

Referring further to FIG. 1, the present tie also includes a pair of eyes 18 and 20, each formed of metal or plastic loops. Each eye 18 and 20 is connected to the central segment 12 so as to be operable on the side of the tape opposite the filamentary material; i.e., the eyes 18 and 20 serve as loops for the end segments 14 and 16 whereby the end segments 14 and 16 can be doubled back, cinched tightly and coupled to the central segment 12 to form the loops of a figure eight. The eyes 18 and 20 are located intermediate the end segments 14 and 16 spaced longitudinally therefrom and from at least a portion of the adjacent mating surfaces therefor of the central region 12. In the embodiment illustrated, the eyes 18 and 20 are located closely adjacent one to the other on the same half of the central segment and at approximately one-third of the total length of the tie. By such configuration, loops of the appropriate different sizes can be formed, as will be described hereinafter, for securement of skis and ski poles, respectively and to each other.

The eyes 18 and 20 are secured to the tie by suitable means, such as by passing the tie therethrough and forming retaining loops 22 and 24 by stitching such as at 26 and 28. Additionally, a reinforcing strip of the same type surface, i.e., female, is secured by stitching 30 to the central segment 12 bridging the location of the eyes 18 and 20 to add strength at the eye junctures.

Figure 2:
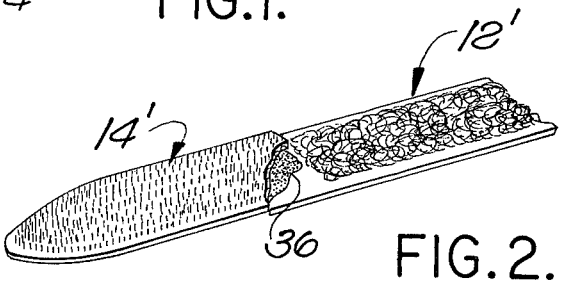
FIG. 2 is a perspective view partly in cross-section of the juncture between strap portions in accordance with an alternative embodiment.

In the embodiment shown in FIG. 1, the end segments 14 and 16 are joined to the central segment 12 by stitching 32 and 34. Referring now to FIG. 2, an alternative embodiment is illustrated wherein the surfaces of the end segments, such as 14', are joined to the central segment 12' by means of heat-sealing adhesive 36, as known, applied to a top surface portion of the central segment 12' from which the filamentary female surface has been removed (or which is originally manufactured with a bare surface). It will be appreciated that a reverse configuration can be used and that the other junctions which are illustrated in FIG. 1 as stitched can also be connected by the use of heat-sealing adhesive or the like.

Figure 3:
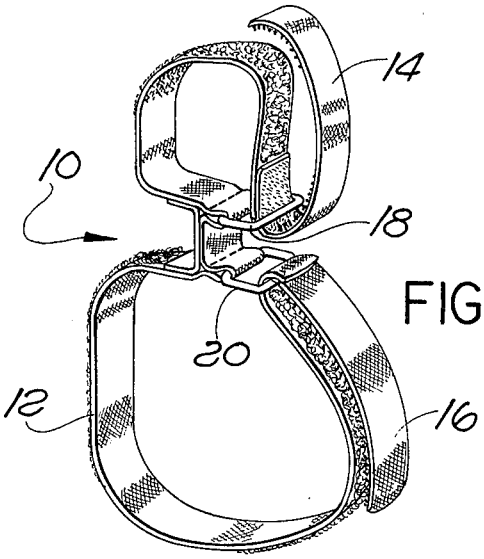
FIG. 3 is a perspective view of the strap of FIG. 1 formed into a figure eight configuration.

Referring now to FIG. 3, to form a figure eight configuration, each end segment 14 and 16 is threaded through an eye 18 and 20, respectively, and doubled back so that its male surface matingly confronts the adjacent female surface of the central segment 12.

Figure 4:
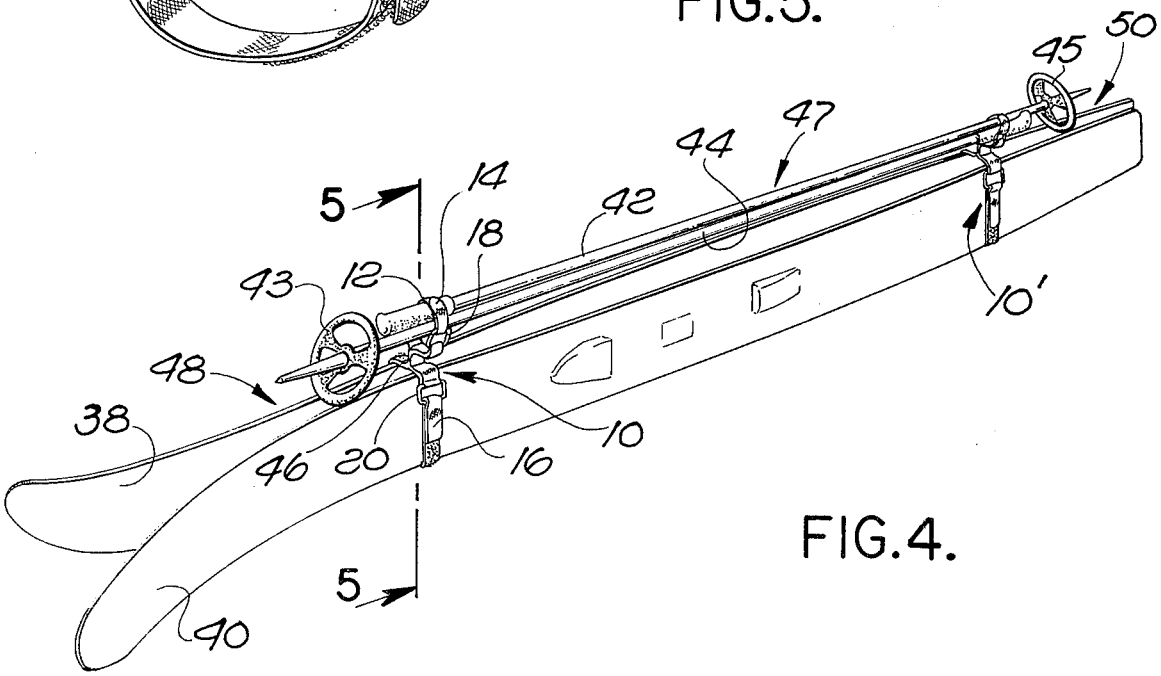
FIG. 4 is a perspective view of a pair of skis and a pair of ski poles strapped together with ties of this invention.

Referring to FIG. 4, there is illustrated the manner of securement of a pair of skis 38 and 40 and ski poles 42 and 44. The end segment 14 of the short end of the tie 10 is wrapped around the poles 42 and 44, threaded through its eye 18, doubled back, cinched tightly, and secured against an adjacent female portion of the central segment 12. In like manner, the end segment 16 of the long end of the tie 10 is wrapped around one end of the skis 38 and 40, threaded through its eye 20, doubled back, cinched tightly, and secured against an adjacent female portion of the central segment 12. In similar manner, the opposite ends of the ski poles 42 and 44 and skis 38 and 40 are secured by a second tie 10′.

The length of tape segment 12 between the eye-retaining loops 22 and 24 constitutes a spacer segment 46 separating the skis and poles. Its length is such as to cause the baskets 43 and 45 of the poles 42 and 44, respectively, to pull tightly against the edge of the skis 38 and 40, flexing about its rubber or leather axle. The result is a firm securement of the poles to the skis. Additionally, the length of the eye-retaining loop 24 should be sufficient so that the eye 20 for the long end of the tie is located along a side of one of the skis when the spacer segment 46 is positioned over the center of the two skis 38 and 40 and the tie 10 is tightly cinched.

Figure 5:
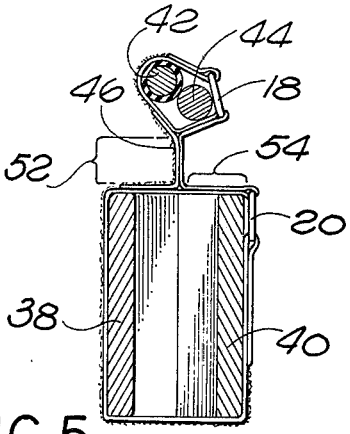
FIG. 5 is a view on line 5—5 of FIG. 4.

Referring additionally to FIG. 5, I have found that for a wide variety of pole basket shapes and skis, a suitable dimension for the spacer segment 46 is about ½ inch as indicated at 52. Also, as shown at 54, a desirable length for the eye-retaining loop 24 is at least ¾ inch.

For a particular embodiment, the length of the female segment of the long end of the tie is about 7½ inches, that of the female segment of the short end is about 3¾ inches, and that of each male free end segment 14 and 16 is about 2¼ inch. Tapes ½ inch to 2 inches wide can be used. The result is a compact, rigidly secured bundle which can be gripped centrally by the poles, e.g. at 47, and carried. When it is desired to untie the equipment, the ties 10 and 10′ are merely peeled apart and can then be wrapped around the tops of the poles 42 or 44 or else are easily carried in a pocket.

Additionally, when it is desired to store the skis 38 and 40, the ties can be used as simple straps, securing the skis 38 and 40 together at their ends, e.g., at 48 and 50, thereby preserving the camber of the skis.

I claim:

1. A tie for securing together a pair of skis and a pair of ski poles, comprising:

an elongate flexible tape having opposite free end segments and a central segment therebetween, each free end segment and a respective portion of said central segment adjacent thereto having, on a first side of said tape, inter-engagable surface portions including a first surface portion provided with a multiplicity of male hook-shaped filamentary members and a second surface portion provided with a multiplicity of female loop-shaped filamentary members releasably inter-engagable with said male filamentary members; and first and second eyes for receiving therethrough respective ones of said free end segments, located on said central segment between said free end segments and spaced one from the other on a second side of said tape to define a flexible spacer segment therebetween, each eye being longitudinally spaced from at least part of the adjacent interengagable surface portion of said central segment and from a respective free end segment to define a long tape free end segment and a short tape free end segment whereby first and second enclosures for said skis and said ski poles, respectively, can be formed by threading said free end segments through said first and second eyes, respectively, for retention by engagement of their filamentary surfaces with the filamentary surfaces of respective adjacent portions of said central segment, said first and second enclosures being spaced apart by said spacer segment.

2. The tie of claim 1 including a reinforcing strip of material secured on said first tape side bridging the locations of said eyes across said spacer segment and having an outer surface portion matingly inter-engagable with said free end segments.

3. The tie of claim 1 wherein the length of said spacer segment is about ½ inch.

4. The tie of claim 1 wherein said first and second eyes are secured to first and second loops, respectively, of said tape dependent from said second tape side.

5. The tie of claim 4 wherein the loop respective said long tape free end extends from said second tape side a distance of at least ¾ inch.

* * * * *

UNITED STATES PATENT AND TRADEMARK OFFICE

CERTIFICATE OF CORRECTION

PATENT NO. : 3,947,927

DATED : April 6, 1976

INVENTOR(S) : Allen M. Rosenthal

It is certified that error appears in the above-identified patent and that said Letters Patent are hereby corrected as shown below:

Col. 4, lines 22-23, delete "a long tape" and substitute therefor --first and second--.

Col. 4, line 23, delete "segment and a short".

Col. 4, lines 23-24, delete "free end segment" and substitute therefor --segments--.

Col. 4, lines 43-44, delete "the loop respective said long tape free end" and substitute therefor --at least one of said loops--.

Signed and Sealed this

Twelfth Day of October 1976

[SEAL]

*Attest:*

RUTH C. MASON
*Attesting Officer*

C. MARSHALL DANN
*Commissioner of Patents and Trademarks*